US007762542B2

(12) United States Patent
Tagawa et al.

(10) Patent No.: US 7,762,542 B2
(45) Date of Patent: Jul. 27, 2010

(54) PAPER FEEDER AND BOOKBINDING APPARATUS EQUIPPED WITH THE SAME

(75) Inventors: Yoichi Tagawa, Ushiku (JP); Takuya Sakamoto, Yamanashi (JP); Toshiya Sato, Otsuki (JP)

(73) Assignees: Canon Finetech Inc., Misato-shi, Saitama (JP); Nisca Corporation, Minamikoma-gun, Yamanashi (JP)

( * ) Notice: Subject to any disclaimer, the term of this patent is extended or adjusted under 35 U.S.C. 154(b) by 34 days.

(21) Appl. No.: 11/979,574

(22) Filed: Nov. 6, 2007

(65) Prior Publication Data

US 2008/0111292 A1 May 15, 2008

(30) Foreign Application Priority Data

Nov. 9, 2006 (JP) ..... 2006-304297

(51) Int. Cl.
*B65H 33/04* (2006.01)
*B65H 39/00* (2006.01)

(52) U.S. Cl. ..... 270/58.17; 270/58.27; 270/58.16

(58) Field of Classification Search ..... 270/58.27, 270/58.16, 58.17
See application file for complete search history.

(56) References Cited

U.S. PATENT DOCUMENTS 6,991,331 B2 * 1/2006 Kagami et al. ..... 347/108

FOREIGN PATENT DOCUMENTS

JP 2006-082901 3/2006
JP 2006082901 A * 3/2006

* cited by examiner

*Primary Examiner*—Gene Crawford
*Assistant Examiner*—Yolanda Cumbess
(74) *Attorney, Agent, or Firm*—Manabu Kanesaka

(57) ABSTRACT

Tray means for stacking sheets, pickup means for separating and for conveying sheets into a single sheet on the tray means, and sheet conveyance means for conveying a sheet separated by the pickup means to a predetermined processing position are provided. Projecting guide means project from a sheet support surface of the tray means into a notched opening of the sheet is provided; and an oblique surface is formed to prevent a trailing side edge of the opening from catching on a leading side edge of the opening of a lower sheet when feeding an uppermost sheet to the projecting guide means. This makes it possible to feed only the uppermost sheet downstream without an opening edge formed in the uppermost sheet from interfering with an opening edge of a lower sheet.

14 Claims, 8 Drawing Sheets

PAPER FEEDER AND BOOKBINDING APPARATUS EQUIPPED WITH THE SAME

BACKGROUND OF THE INVENTION

1. Field of the Invention

The present invention relates to document feeders such as a printer or printing machine that sequentially separate stacked sheets into single sheets for conveyance, and more particularly to document feeders such as inserters and the like that collate sheets printed at an image-forming apparatus or the like and insert cover sheets for a bookbinding process, and accurately separate and convey special sheets such as those having a window opening therein.

2. Description of the Related Art

Generally, a variety of apparatuses that consecutively print sheets, such as printing machines, copiers or so-called printing systems are recently being used as on-demand printing systems. In such printing systems, not only are sheets printed using a predetermined printing process and discharged, but also finishers are widely used to sort discharged sheets into a predetermined number of sheets, align them, and then implement a predetermined finishing process thereto, such as stapling or gluing or the like. There are cases in which a cover sheet or a partitioning sheet must be inserted, depending on the process at the finisher, such as partitioning or collating. Therefore, an inserter is disposed between the image-forming apparatus and the finisher linked thereto to insert cover sheets or partitioning sheets to a predetermined order position of sheets sequentially conveyed out from the image-forming apparatus. Thereafter, the series of sheets are bound or collated.

The types of sheets handled by that kind of inserter can be a thick sheet such as a cover sheet, or a thin sheet, such as traditional Japanese paper. It could also be coated sheets, such as glossy paper, or OHP sheets that are also in wide use. Thus, a paper feeder that precisely feeds one sheet at a time from a stacker is in demand. This kind of conventional paper feeder that is provided a vacuum pick-up for vacuuming an edge of a stacker to pull out single sheets is known as a printing system. Paper feeders equipped with this kind of vacuum pick-up are able to separate and feed a wide variety of sheets comparatively accurately, but they are large and require space for installation. They are also expensive.

On the other hand, different types of office equipment, such as copiers, printers or facsimile machines are well known feeding apparatuses that use feeding rollers to touch sheets, kick out sheets stacked on a stacker, and to separate the sheets into single a sheet for feeding (along with a separation member such as a friction pad or separating rollers (retard rollers)). Also, downstream of the feeding rollers, conveyance means are provided to receive and convey sheets to a processing position. For example, a pair of rollers is arranged in a sheet conveyance guide downstream of the feeding rollers. These are registration rollers. They are stopped when the leading edge of the sheet is fed from the feeding rollers. That action causes the sheet to bend and that enables the leading edge of the sheet to become properly aligned (to remove any skewing). This registration roller mechanism that feeds sheets toward the processing position is widely known.

A separation mechanism using friction described above is composed of one feeding roller arranged in the center of the width direction of a sheet and a separation member (reverse rotating roller or pad or the like) that is in contact thereto. The feeding roller kicks out the sheet, but the separation pad inhibits the double-feed of sheets. To prevent a double-feed or non-feed with such a structure for separation, the feeding roller and separation member are composed of materials providing a high coefficient of friction. Increasing the contact pressure therebetween is widely known, but examples have not conventionally been provided. Nevertheless, separation devices are widely known.

However, if the coefficient of friction and contact pressure are high, ordinary paper (particularly thin sheets) can become wrinkled or box-eared which damages the sheet. The friction between the feeding rollers and the friction member can become too high which increases the frequency to replace parts. When feeding sheets toward the processing position with this registration mechanism, the feeding rollers are stopped so that subsequent sheets are not fed and the registration rollers pull the sheet to convey it. At that time, if there is a high coefficient of friction between the feeding rollers and the separation member, the conveyance load will be increased which causes the problem of having to vary the load according to the type of sheet.

A wide range of sheet types are used as cover sheets. This includes special sheets such as windowed sheets formed with notched openings for a title. To stack and store sheets so that an edge of the notched window and the leading edge of the next sheet do not catch each other when windowed sheets to be discharged are stacked vertically, a jump member that projects upward from the tray support surface is provided in a tray structure for handling windowed sheets. Sheets sequentially advancing are caused to jump by an oblique surface provided on the jump member. (See Unexamined Japanese Pat. Pub. 2006-82901.)

However, if windowed sheets are stacked in tray means and sequentially fed downstream starting from the uppermost sheet, the edge of the notched opening of the sheet can get caught on the notched opening of a lower sheet which leads to a non-feed or a double-feed. A method for manually feeding single special sheets from a manual feed inlet has been adopted, but that is not appropriate for an apparatus that operates continually.

Thus, the inventors analyzed the behavior of sheets when windowed sheets formed with window openings such as for titles, and the like, are separated and conveyed. They discovered that the opening edge of the trailing side gets caught on the leading edge of the of a lower sheet when the uppermost sheet is kicked out and fed along the lower sheet which causes a double-feed. It was also learned that a double-feed or a non-feed happens more easily when upper and lower sheets have been pressed closely to be cut to form the window in this kind of windowed sheet.

The present invention provides a paper feeder that securely separate and feed windowed sheets with notched openings stacked on a tray sequentially from the uppermost sheet. Furthermore, the present invention provides a paper feeder that securely separates and feeds either windowed sheets or ordinary sheets to a downstream processing position and bookbinding apparatus equipped with the same.

SUMMARY OF THE INVENTION

The present invention equips on a tray means a projecting guide means that projects into a notched hole of a windowed sheet. The projecting guide means is provided an oblique surface to prevent a trailing edge of the opening in the uppermost sheet from catching an edge of the opening in a lower level sheet. Therefore, it is possible to separatingly convey only the uppermost sheet downstream without interfering with the opening edge of a lower level sheet when the uppermost sheet is fed. Therefore, it is possible to accurately convey sheets to a downstream processing position without improper sheet separations, such as so-called double-feeds or non-feeds and the like.

Furthermore, the present invention allows the projecting guide means to be detachable to a sheet support surface of the tray means, capable of rising from and falling to that surface, or for a plurality of tray means to be selectably mounted so windowed sheets or normal paper can be set in any tray thereby enabling accurate separation and conveyance of both types of sheets.

DESCRIPTION OF THE PREFERRED EMBODIMENTS

Figure 1:
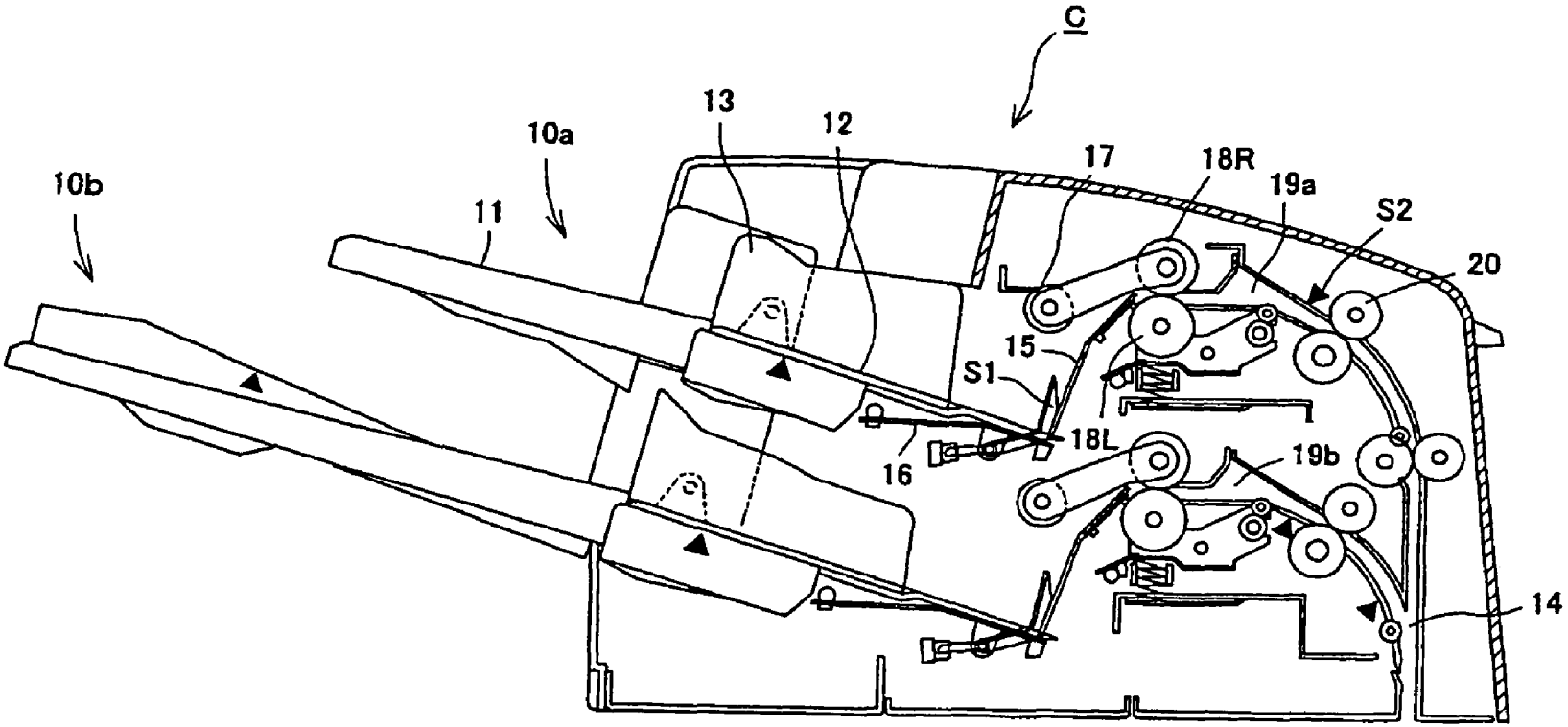
FIG. 1 is an expanded sectional view of a paper feeder (an inserter in a bookbinding apparatus) according to the present invention.

The following will explain the paper feeder C according to the present invention. As shown in FIG. 1, the paper feeder C is composed of a first tray 10*a* and a second tray 10*b* that stackingly store sheets. The first and second trays 10*a* and 10*b* are disposed one above the other; the first tray 10*a* positioned above stores small sized sheets; the second tray 10*b* positioned below stores large sized sheets. The structure of the first and second trays 10*a* and 10*b* are the same, so the explanation will focus on the first tray 10*a*; an explanation of the second tray 10*b* will be omitted.

The first tray 10*a* has a trailing edge support surface 11 that supports trailing edges of sheets and a leading edge support surface 12 that supports leading edges of sheets; the trailing edge support surface 11 is fastened to the apparatus frame and the leading edge support surface 12 is born to swing in up and down directions of FIG. 1. A rising and lowering lever 16 is mounted to the leading edge support surface 12. A lift motor, not shown, is connected to the rising and lowering lever 16; rotation of the lift motor swings the rising and lowering lever 16 in the up and down directions. A first feeding path 19*a* that feeds one sheet at a time is disposed downstream of the first tray 10*a*; a second feeding path 19*b* is connected in the same way downstream of the second tray 10*b*. These first and second feeding paths 19*a* and 19*b* converge to connect to one conveyance path 14; sheets are fed one at a time from the conveyance path 14.

A left and right pair of side guides (side aligning members) 13 are established on the first tray 10*a* to align the edge positions of sheets on the tray. The side guides 13 are composed of a right and left pair of guide plates 13*a* and 13*b*. An interlocking mechanism is provided so that these guides 13*a* and 13*b* move the same amount in opposite directions; they move mutually toward and away from each other based on a center of the sheet conveyance direction.

A gate stopper 15 is provided at the leading edge of the first tray 10*a* to engage and align leading edges of sheets when sheets are set on the tray. Also, a pickup roller 18R and registration roller 20 are disposed in the first feeding path 19*a* downstream of the first tray 10*a*. A separation roller 18L is pressed against the pickup roller 18R and is composed of a retarding roller that rotates in a direction opposite to that of the pickup roller 18R. A kick roller 17 is disposed above the first tray 10*a* and feeds sheets on the tray toward the pickup roller 18R. Note that instead of the pickup roller 18R and the kick roller 17 as shown in the drawing, it is also acceptable to implement a belt configuration, for example, with a pair of belts trained between pulleys.

The separating roller 18L and pickup roller 18R act to suppress the feeding of two or more sheets so that there is not a double feed of two or more sheets kicked out by the kick roller 17. Therefore, the pickup roller 18R and the separating roller 18 compose the pickup means. It is also acceptable to adopt a stationary, fixed roller, or a friction pad made of rubber or sponge instead of a retard roller for the separation roller 18L. A registration roller 20 is disposed downstream of the pickup roller 18R to correct skewing of sheets fed by the pickup roller 18R.

An empty sensor S1 that detects sheets is disposed on the first tray 10*a*; a registration sensor S2 is disposed just in front of the registration rollers 20. The pickup roller 18R and separation roller 18L are disposed in plurality in a direction perpendicular to the sheet conveyance direction. Forward drive from a drive motor (not shown) is transmitted to the pickup roller 18R, separation roller 18L and kick roller 17; reverse rotation is transmitted to rotate the registration roller 20.

Note that each of the rollers having the same functions as the kick roller 17, pickup roller 18R, retard roller 18L and registration roller 20 disposed in the first feeding path are arranged in the same order in the second feeding path 19*b* toward downstream of the second feeding path 19*b*.

Figure 2A:
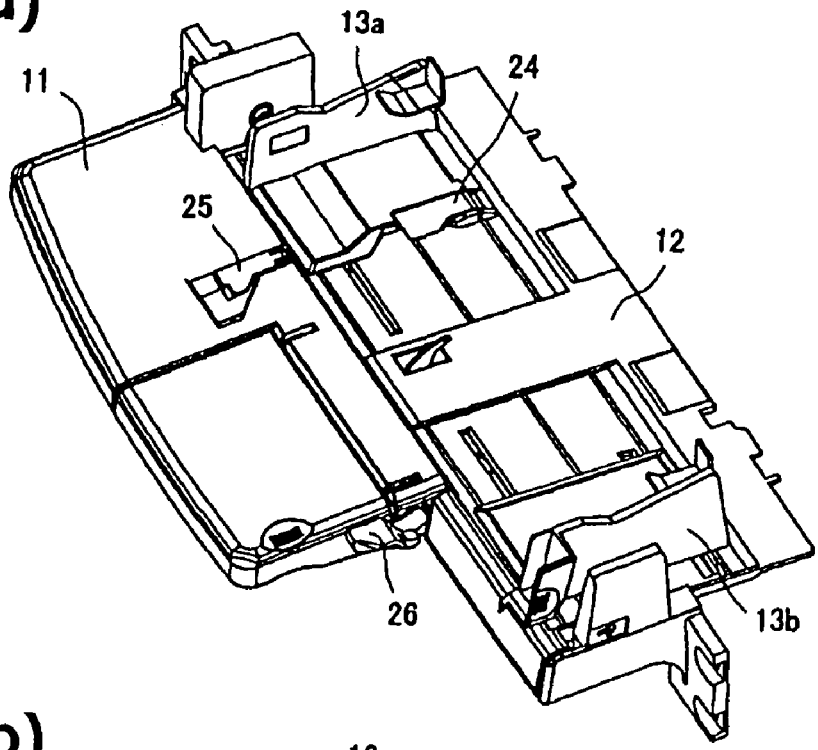
FIGS. 2(*a*) and 2(*b*) are perspective views of a tray; 2(*a*) is a sectional view of the projecting guide equipped on the tray laid down in a non-operational state; 2(*b*) is a sectional view of the projecting guide raised in an operational state.
Figure 2B:
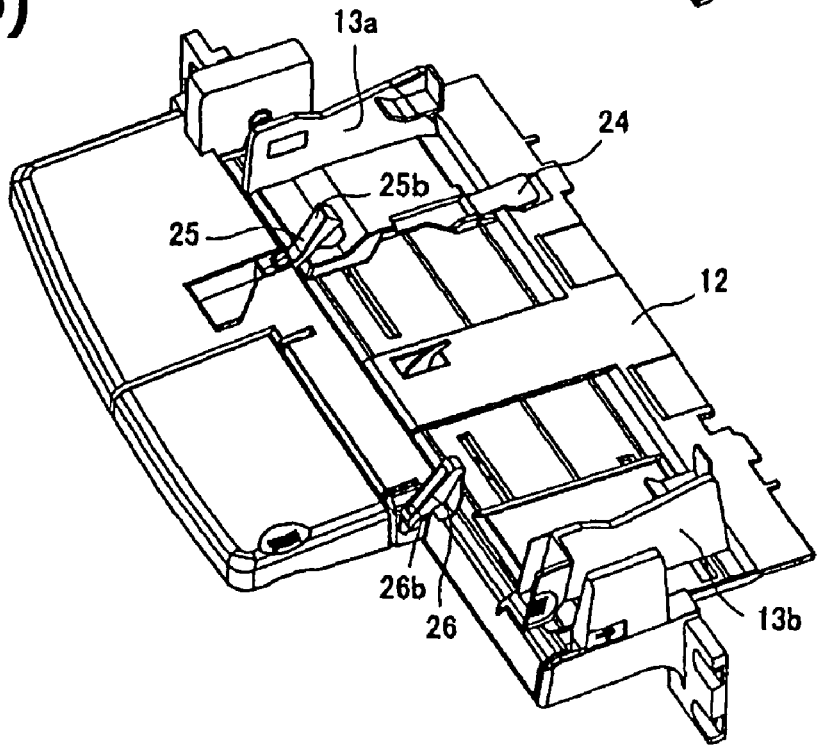
Figure 3:
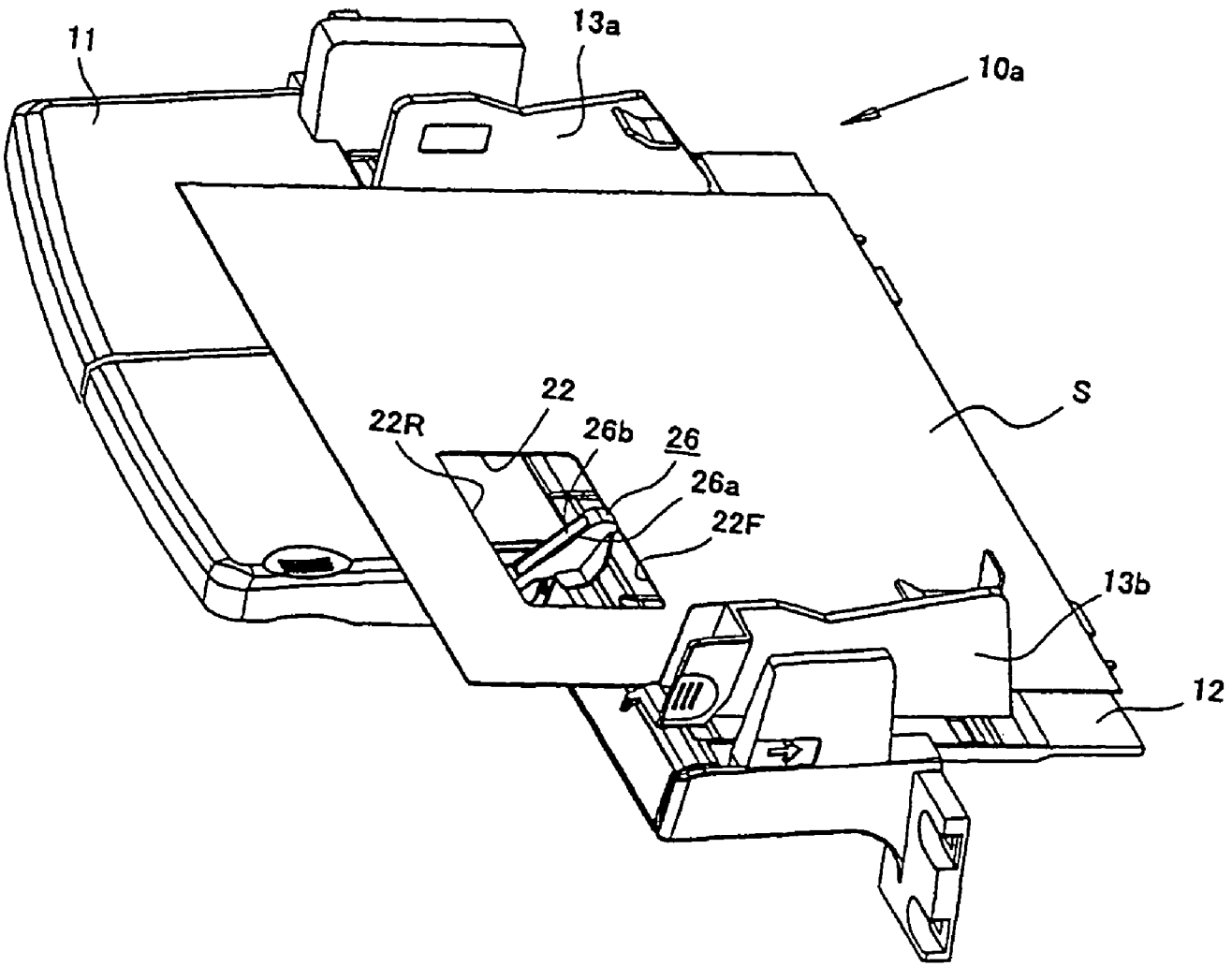
FIG. 3 is a perspective view of a windowed sheet having a longitudinal opening stacked on the tray.
Figure 4:
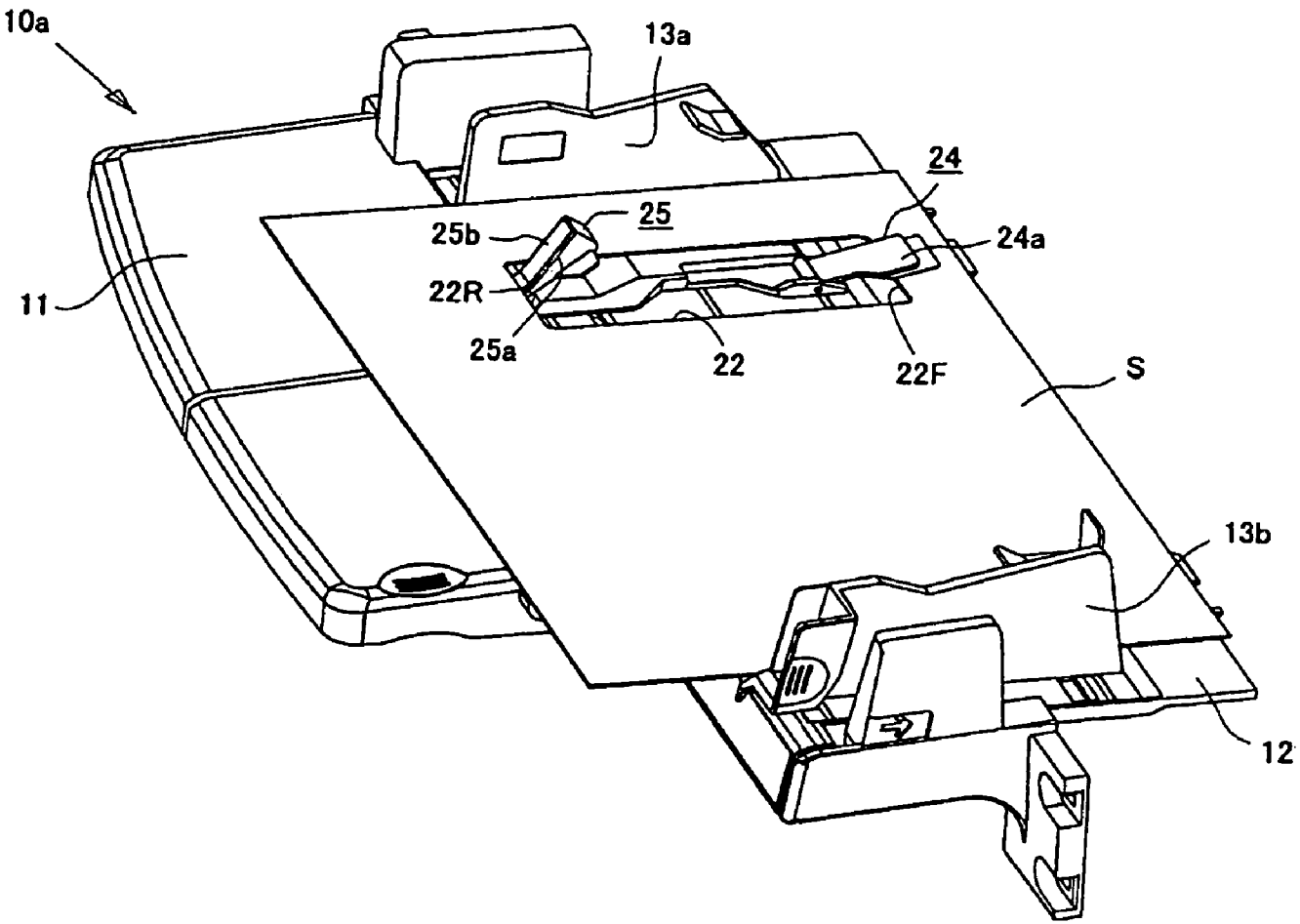
FIG. 4 is a perspective view of a windowed sheet having a horizontal opening stacked on the tray.

The following will now explain the first and second trays 10*a* and 10*b* in further detail. FIGS. 2(*a*) and 2(*b*) are perspective views of the tray 10*a*. Also, FIG. 3 is a view showing a bundle of sheets each having a narrow opening (longitudinal opening) formed in a direction perpendicular to the sheet conveyance in stacked state. FIG. 4 is a view showing a bundle of sheets each having a narrow opening (horizontal opening) formed in a direction perpendicular to the sheet conveyance in stacked state.

The configuration is provided for stacking windowed sheets on at least one of either the first or the second trays 10*a* and 10*b*. A notched opening 22 is formed at a predetermined position in the windowed sheet S, as shown in FIGS. 3 and 4. When a windowed sheet is kicked out in a feeding direction from the uppermost sheet stacked vertically, the trailing edge opening 22R catches on the front edge 22F of the notched opening of a lower sheet causing double-feeds or non-feeds.

Thus, a first, a second and a third projecting members or guides 24, 25, and 26 that project into the notched opening 22 of the sheets are provided. The projecting guides 24, 25, and 26 are positioned laying down, as shown in FIG. 2(*a*) when ordinary sheets (sheets without notched openings or windows) are stacked. However, when windowed sheets formed with the notched openings are stacked, each of the projecting guides 24, 25, and 26 are configured to move to a standing position, as shown in FIG. 2(*a*), depending on the type of windowed sheet.

To explain each projecting guide 24, 25, and 26 in detail, the first and second projecting guides 24, and 25 are provided to project into the notched opening 22 when an elongated opening (longitudinal opening) is formed in the windowed sheet as shown in FIG. 4. The third projecting guide 26 is provided to project into the notched opening 22 when an elongated opening (lateral opening) is formed in the windowed sheet S as shown in FIG. 3. Each of these projecting guides 24, 25, and 26 is installed to rise and lower on the tray 10*a*. They are rotatably supported on the tray 10*a* by rotating shafts 29*a*, 29*b*, and 29*c*. They are configured to manually rise and lower to an operating state standing (or projecting) in the notched opening 22 (see FIG. 5(*a*)) and a lowered, non-operating position (see FIG. 5(*b*)). Note that in FIGS. 5(*a*) and 5(*b*), only the third projecting guide 26 is raised.

Also note that according to this embodiment, of each of the projecting guides 24, 25, and 26, the first projecting guide 24 is installed to rise and lower on the side guide 13*a*, and the second and third projecting guides 25, and 26 are installed on the trailing edge support surface 11. This is related to the apparatus layout. It is acceptable to arrange them on the side guides 13, or the stacking surface of the trays of the leading edge support surface 12 or trailing edge support surface 11.

If there is a plurality of sizes of windowed sheets, the projecting guides 24, 25, and 26 can also be configured on the support surface 12 to move in a direction perpendicular to conveyance. For example, this is supported by one of the support members (interlocked members) of the guide plates 13*a*, and 13*b*, so when the right and left pair of guide plates 13*a* and 13*b* are moved in the width direction, the projecting guides 24, 25, and 26 also move as one body. Specifically, each of the projecting guides 24, 25, and 26 is arranged to move in a direction perpendicular to conveyance, and are installed to move as one body with the right and left pair of guide plates 13*a* and 13*b*.

Figure 6A:
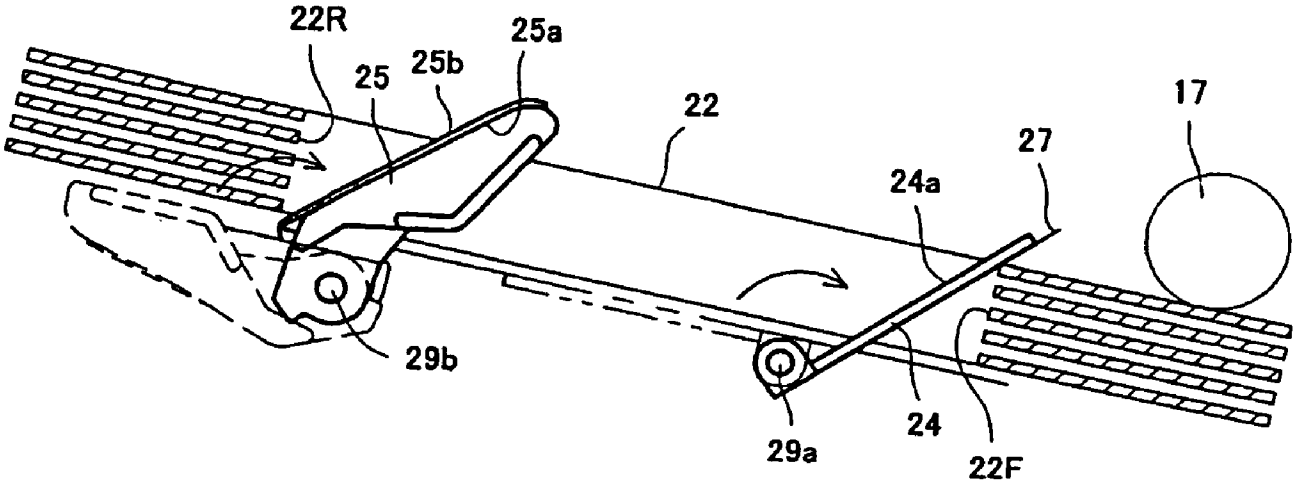
FIGS. 6(*a*) and 6(*b*) are sectional views showing the operation to feed a sheet on the tray; 6(*a*) is a sectional view of a sheet set on the tray; 6(*b*) is a sectional view showing the uppermost sheet on the tray being fed.
Figure 6B:
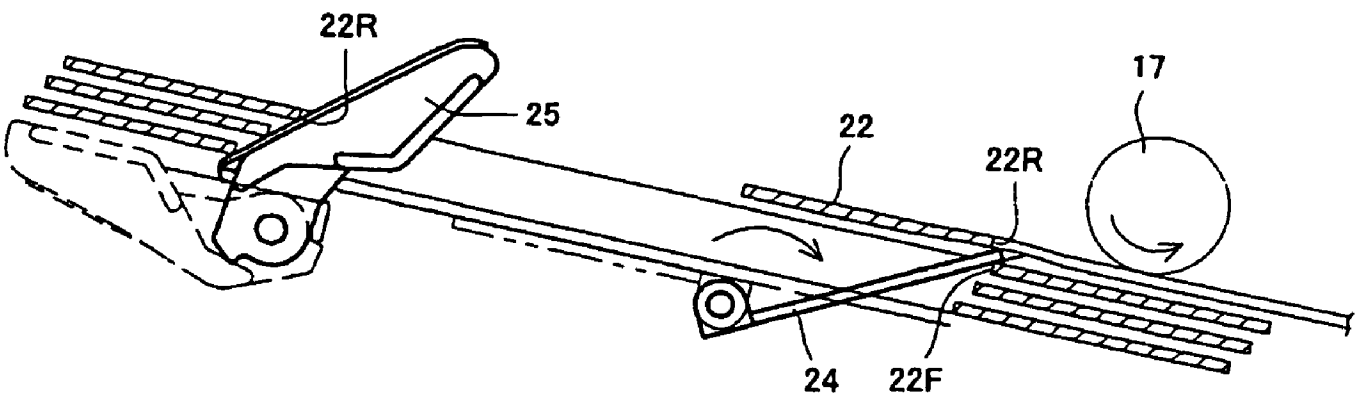

The following will now explain when a windowed sheet with a longitudinal opening 22 is stacked with reference to the perspective view of FIG. 4, and the sectional views of FIGS. 6(*a*) and 6(*b*). In this case, the first and second projecting guides 24, and 25 are in their raised operating states when windowed sheets with longitudinal openings are stacked. In this operating state, the first projecting guide 24 is positioned at the leading edge of the opening 22; the second projecting guides 25 is arranged to be positioned at the trailing edge. Note that when a windowed sheet with the longitudinal opening 22 is stacked, the third projecting guide 26 is at its lowered, non-operating position.

Also, as shown in FIG. 6(*a*), the first projecting guide 24 engages the edge of the opening of the uppermost sheet, and rotates in the direction of the arrow in FIG. 6(*a*) along with the gradually diminishing amount of sheets, centering on a rotating shaft 29*a* to constantly be positioned to the uppermost sheet. This allows movement along a guide surface 24*a* of the first projecting guide 24 without the trailing edge 22R of the windowed sheet opening 22 catching on the front edge 22F of the notched opening of a lower sheet, as shown in FIG. 6(*b*).

Also, an oblique surface 25*a* is formed on the second projecting guides 25 positioned at the trailing edge 22R opening of the notched opening 22 of the sheet; a separation pad 25*b* with a high coefficient of friction to separate sheets is attached to this oblique surface. This separation pad 25*b* touches the trailing edge 22R of the opening 22 of the windowed sheet and acts to separate the uppermost sheet and a lower sheet when the uppermost sheet of the windowed sheets is kicked out. This securely prevents the dragging or double-feed caused by a windowed sheet that is punch formed using a press or the like.

The following will explain the operations to kick out a windowed sheet with a longitudinal opening 22, stacked on the tray 10*a*. A windowed sheet having the longitudinal opening 22, stacked on the tray 10*a* is pressed against the kick roller 17 by the rising of the rising and lowering lever 16, and is kicked out by the rotation of the kick roller 17 and pickup roller 18R to advance between the pickup roller 18R and separation roller 18L. At that time, the separation roller 18L rotates in an opposite direction to the pickup roller 18R so only the uppermost sheet is fed to the registration rollers 20. During the process, the notched opening 22 formed in the uppermost sheet is guided above the notched opening 22 in the lower sheet along the oblique surface 24*a* of the projecting guides 24, as shown in FIG. 6(*b*). At the point where the trailing edge 22R of the opening of the uppermost sheet passes the front edge 22F of the opening of the lower sheet, it advances to the pickup roller 18R while touching the top of the lower sheet. Therefore, the trailing edge 22R of the opening of the uppermost sheet is guided smoothly to the pickup roller 18R without getting caught on the front edge 22F of the opening of the lower sheet. The uppermost and lower sheets are separated by separation pad 25*b* of the oblique surface 25*a* and the uppermost sheet is conveyed.

Note that 27 represents a flexible film member affixed to an opposing surface of the oblique surface 25*a*; the film member 27 extends further than the leading edge of the first projecting guide. This film member bends so that it does not prevent the passage of sheets even when there is a low number of windowed sheet stacked on the tray 10*a*.

Figure 5A:
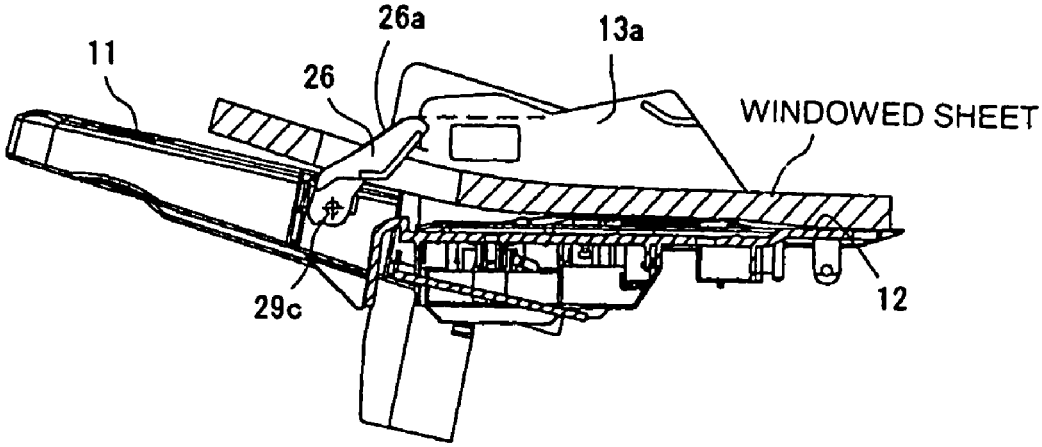
FIGS. 5(*a*) and 5(*b*) are sectional views showing relationships of the projecting guide and the sheet; 5(*a*) shows the projecting guide raised to an operational state; 5(*b*) shows the projecting guide lowered to an operational state.
Figure 5B:
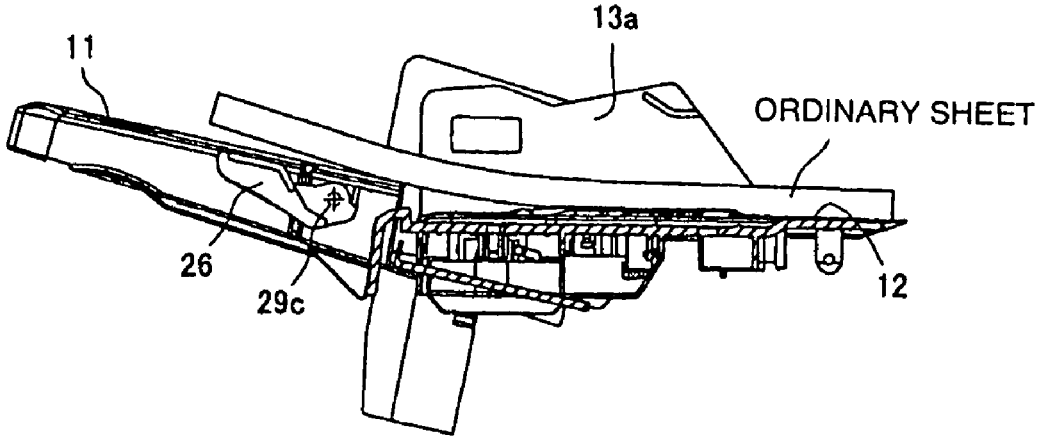

The following will now explain when a windowed sheet with a horizontal opening 22 is stacked with reference to the perspective view of FIG. 3, and the sectional views of FIG. 5(*a*). For horizontal openings 22, the third projecting guide 26 arranged at the trailing edge of the opening 22 is raised to its operating state. At this time, the first and second projecting guides 24, and 25 are laid down to their non-operating positions.

As shown in FIG. 3, a separation pad 26*b* with a high coefficient of friction to separate sheets is attached to the oblique surface oblique surface 26*a* of the third projecting guide 26 positioned at the trailing edge 22R opening of the notched opening 22 of the sheet.

In the same way as the windowed sheet having a longitudinal opening 22 is kicked out, the windowed sheet having a horizontal opening 22 is kicked out by the rotation of the kick roller 17 and the pickup roller 18R and fed to the registration rollers 20 by the pickup roller 18R and retard roller 18L. In the process, the lower sheet is separated by the separation pad 26*b* of the oblique surface 26*a* so only the uppermost sheet is fed, as shown in FIG. 5(*a*). Also, as shown in FIG. 4, the opening 22 of a windowed sheet having a horizontal opening 22 is shorter in the conveyance direction, so the trailing edge 22R of the opening of the uppermost sheet being conveyed pass above without touching the front edge 22F of the opening of the lower sheet by the oblique surface 26*a* of the third projecting guide 26. Therefore, the trailing edge 22R of the opening of the windowed sheet does not get caught on the front edge 22F of the notched opening of a lower sheet.

Note that according to the present invention, the configuration separates the first projecting guide 24 and the second projecting guide 25 to the front and back, but it is acceptable to configure both guides 24, and 25 as one, single-body guide member.

Also, in the embodiment described above, each of the projecting guides 24, 25, and 26 is configured to rise and lower to the support surface of the first tray 10*a* tray. However, alternatively, it is also possible to configure the first tray 10*a* to be detachable from the apparatus frame and equip a plurality of attachment trays that form the first tray, and form at least one of the projecting guides. By replacing the attachment tray, it is possible to selectively configure a support surface for stacking windowed sheets, or a support surface for stacking normal sheets.

Specifically, the attachment tray is detachable to the apparatus frame. An attachment tray equipped with the projecting guide and an attachment tray, not equipped with the projecting guides, are provided.

Figure 7:
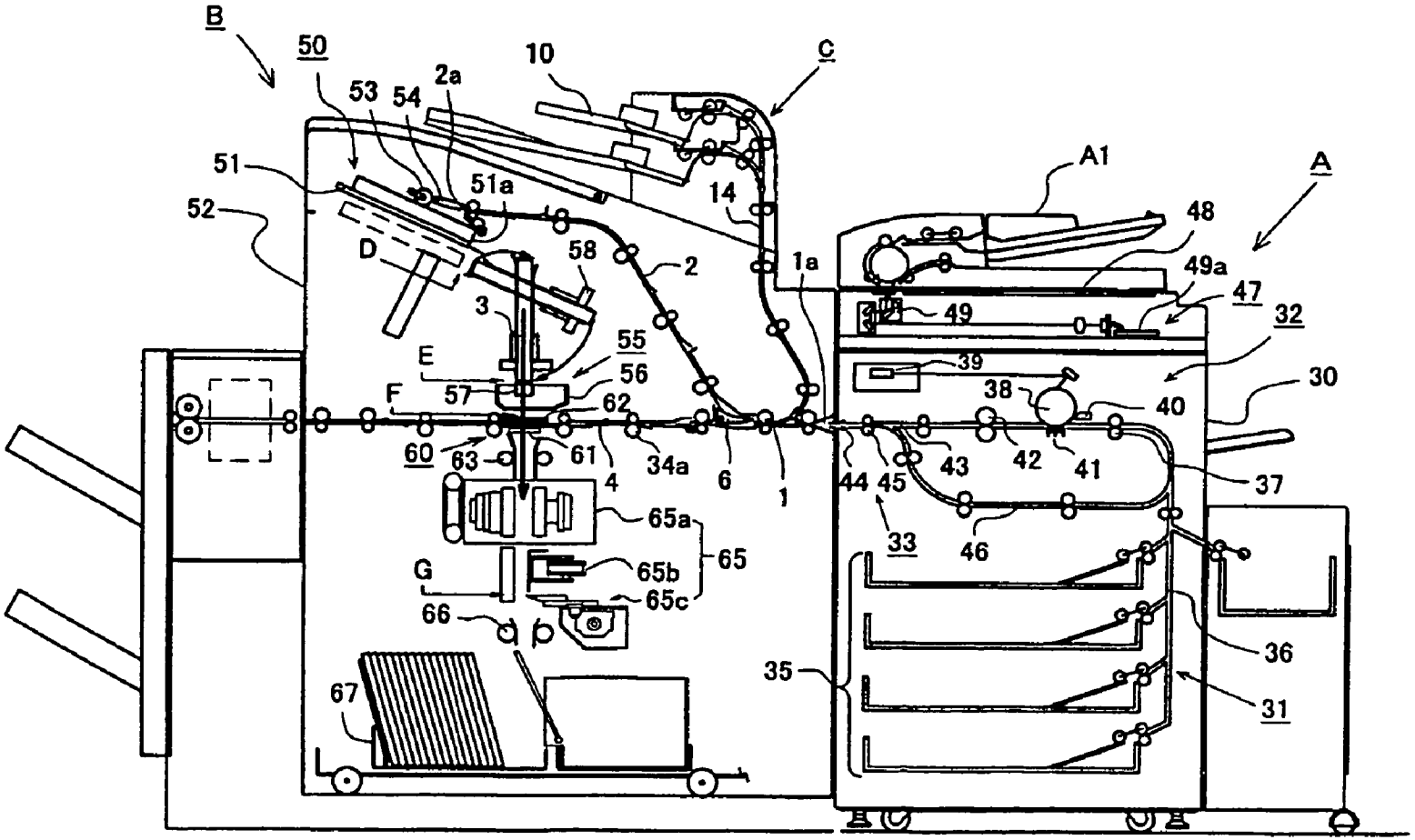
FIG. 7 is an overall view of the image-forming apparatus equipped with a paper feeder according to the present invention.
Figure 8A:
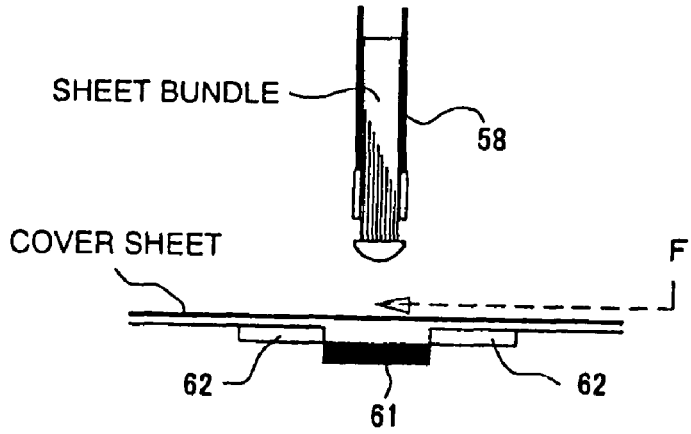
FIG. 8 is an explanatory view of a sheet binding process in the apparatus shown in FIG. 7.
Figure 8B:
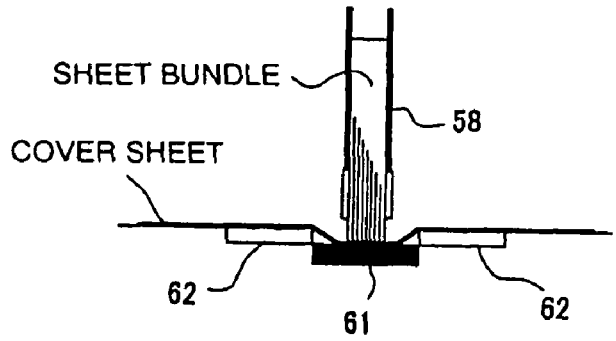
Figure 8C:
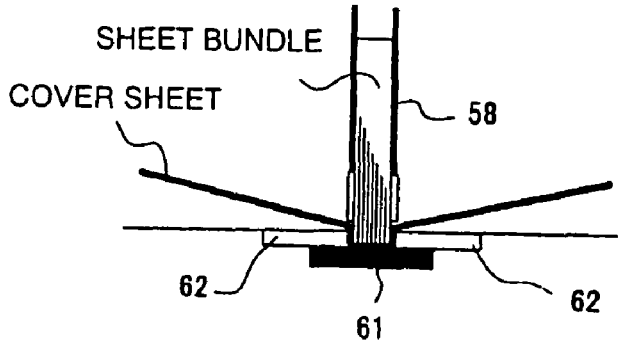
Figure 8D:
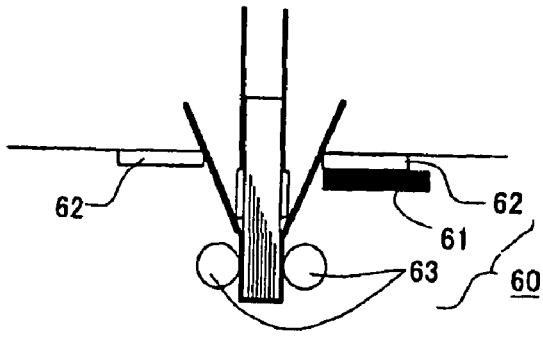

The following will now explain the finisher B installed with the paper feeder C described above and an image-forming apparatus A equipped with the finisher B. The system of apparatuses shown in FIG. 7 is a bookbinding apparatus as the finisher B. The following will now explain the finisher as the bookbinding apparatus B. The image-forming apparatus A shown in FIG. 7 is composed of the image-forming apparatus A that sequentially prints sheets, and the bookbinding apparatus B positioned downstream of the image-forming apparatus A.

Initially, the image-forming apparatus A can adopt a variety of structures such as that of a printer or printing machine. The drawing shows a static electricity printing apparatus. A paper feeder unit 31, a printing unit 32, a discharge unit 33 and a control unit 34 are installed in the casing 30 of the image-forming apparatus A. A plurality of cassettes 35 are prepared in the paper feeder unit 31 to correspond to sheet sizes. Sheets of the size instructed from the control unit 34 are kicked out of a cassette into the paper feed path 36. Registration rollers 37 are established in the paper feed path 36. After the leading edge of the sheet is aligned, the sheet is conveyed to the downstream printing unit 32 at a predetermined timing.

A static electric drum 38 is disposed in the printing unit 32. A print head 39, developer 40, and a transfer charger 41 are arranged in the vicinity of the static electric drum 38. The print head 39 is composed of a laser emitting device, for example. This forms a static-electric latent image on the static-electric drum 38. Toner adheres to the latent image at the developer 40; that image is then printed to the sheet at the transfer charger 41. The image is fixed to the printed sheet at a fixer 42; the sheet is then conveyed out to a discharge path 43. A discharge outlet 44 and discharge roller 45 formed in the casing 30 are equipped in the discharge unit 33. Note that 46 represents cycling path. Printed sheets conveyed from the discharge path 43 are conveyed again to the registration rollers 37 after being turned over from front to back at the switch-back path. This enables the back surface of a printed sheet to be printed with images. In this way, a sheet that has images on one side or both sides is discharged from the discharge outlet 44 by the discharge roller 45.

Note that 47 represents a scanner unit. This optically reads original images to be printed by the print head 39. As is generally known, this structure is composed of a platen 48 where an original sheet is set, a carriage 49 that scans the original images along the platen 48, and an optical reading means (for example a CCD) 49*a* that photoelectrically converts the optical image from the carriage. In the drawing, an original feeder apparatus A that automatically conveys the original sheet to the platen is installed above the platen 48.

The following will now explain the bookbinding apparatus (finisher) B equipped adjacent to the image-forming apparatus A described above. The bookbinding apparatus B is composed of a collector 50 (hereinafter referred to as a collecting tray 51) that collects and aligns printed sheets into a bundle, adhesive application means 55 that applies adhesive to a sheet bundle conveyed from the collecting tray 51, and cover binding means 60 that binds the glued sheet bundle and cover sheet together. A sheet conveyance in path 1 and an insertion sheet conveyance path 2 are provided in the collecting tray 51 upstream thereof, and a bookbinding path 3 is provided downstream thereof. The collecting unit 50 is composed of the collecting tray 51 this is arranged substantially in a horizontal direction. This stores printed sheets conveyed from the discharge outlet 2*a* of the insertion sheet conveyance path 2.

Forward and reverse rotating roller 53 and a conveyance in guide 54 are disposed above the collecting tray 51. A printed sheet conveyed from the discharge outlet 2*a* is guided to the collecting tray 51 by the conveyance in guide 54, and stored in that tray by the forward and reverse rotating roller 53. The forward and reverse rotating roller 53 stores the printed sheet in the collecting tray 51 with a forward rotation, and with a reverse rotation, the roller 53 engages the trailing edge of the sheet to an aligning member 51*a* provided at the trailing edge of the tray to align the edge. Aligning means, not shown, are provided on the collecting tray to align a side edge of printed sheets stacked in the tray to a reference position. With this configuration, the printed sheet conveyed from the sheet conveyance in path 1 is sequentially stacked in the collecting tray 51 and aligned into a bundle.

The following will explain the sheet conveyance path. The sheet conveyance in path 1 having a conveyance inlet 1*a* connected to the discharge outlet 44 of the image-forming apparatus A, and a cover sheet conveyance path 4 connected to the sheet conveyance in path 1 are arranged in the housing 52. A first sheet conveyance path that intersects the sheet conveyance in path 1 and the cover sheet conveyance path 4 is configured to convey a sheet in a substantially horizontal direction. The sheet conveyance in path 1 that guides a sheet to the collecting unit 50 (collecting tray 51) is connected to the sheet conveyance path 1 interposed by a path switching flapper 6, to convey the sheet from the conveyance inlet 1*a* to the collecting tray 51.

A bookbinding path 3 is connected to the collecting tray 51 to convey the sheet bundle substantially in a vertical direction intersecting the apparatus downstream thereof. The second conveyance path (hereinafter referred to as the bookbinding path) composed by the bookbinding path 3, and the first sheet conveyance path (hereinafter referred to as the cover sheet conveyance path) mutually intersect; a cover sheet binding means 60, described below, is disposed in this intersection. The sheet conveyance path 1 composed as described above is connected to a discharge outlet 44 of the image-forming apparatus A described above. This receives printed sheets from the image-forming apparatus A. A sheet (an inner bound sheet) printed with content information and a sheet printed with a title as a cover sheet (hereinafter referred to as a cover sheet) are conveyed from the image-forming apparatus A. The sheet conveyance path 1 is branched to an inner sheet conveyance path 2 and a cover sheet conveyance path 4; printed sheets are sorted and conveyed to each path by the path switching flapper 6.

An inserter (the paper feeder) C is joined to the sheet conveyance path 1. This is configured to supply cover sheets not printed at the image-forming apparatus A is separated into single sheets from the tray means 10 to the sheet conveyance path 1. The inserter C is composed with the structure described above.

The collecting tray 51 is connected to the inner sheet conveyance path 2; the bookbinding path 3 is established downstream of the collecting tray 51. The bookbinding path 3 performs the bookbinding process while sequentially feeding inner sheets stacked into a bundle (hereinafter simply referred to as a sheet bundle). The bookbinding path 3 shown in the drawing is disposed in a substantially vertical direction. A sheet bundle posture deviating position D, an adhesive application position E, a cover sheet binding position F, and a cutting position G are arranged in this order downstream. The cover sheet conveyance path 4 is established to intersect the cover sheet binding position F. This supplies the cover sheet to the cover sheet binding position F.

An adhesive application means 55 is disposed in the adhesive application position E in the bookbinding path 3. This adhesive application means 55 is composed of an adhesive container 56 that stores hot-melt adhesive, an applicator roller 57, and a roller rotating motor (not shown). The applicator roller 57 and roller rotating motor are incorporated into the adhesive container 56. The adhesive container 56 is supported to move along the sheet bundle set at the adhesive application position E. By reciprocatingly moving along the length direction of the sheet bundle in the front to back directions of FIG. 7, adhesive is applied to an edge of the sheet bundle.

Gripping conveyance means 58 that conveyance sheets from the collecting tray 51 is disposed in the adhesive application position E. This gripping conveyance means 58 changes the posture of the sheet bundle stacked in the collecting tray 51 from a horizontal posture to a vertical posture, then conveys the vertically oriented sheet bundle downstream along the bookbinding path 3 to the adhesive application position E. For that reason, the collecting tray 51 moves from a stacking position (the solid lines in FIG. 7) to a hand-over position (the broken lines in FIG. 7) to hand-over the sheet bundle to the gripping conveyance means 58 prepared at this hand-over position.

A cover sheet binding means 60 is disposed in cover sheet binding position of the bookbinding path 3. The cover sheet conveyance path 4 is arranged to intersect the cover sheet binding position F. A cover sheet is fed from the cover sheet conveyance path 4, and is folded over the cover sheet fed from the adhesive application position E to form a booklet at the cover sheet binding position F. For that reason, a backside plate 61 that backs up and supports the cover sheet, back folding plates 62 that pressingly form the joining portion (spine portion) of the sheet bundle and cover sheet, and folding rollers 63 are provided at the cover sheet binding position F. Cover sheet binding means 60 is configured by backside plate 61, back folding plates 62, and folding rollers 63. These perform the bookbinding process with the procedures shown in FIG. 8(*a*) to 8(*d*).

FIG. 8(*a*) shows the state just prior to binding the cover sheet and sheet bundle. The sheet bundle is moved downward in the drawing by the gripping conveyance means 58. The sheet bundle touches the center of the backside plate 61 with the cover sheet being supported by the backside plate 61, as shown in FIG. 8(*b*). A pair of left and right block members of the back folding plates 62 are configured to move between a retracted position where they are retracted from the bookbinding path 3 and an acting position where they mutually touch in the bookbinding path 3. These pressingly form the sheet bundle and cover sheet when they move from the retracted position to the acting position as shown in FIG. 8(*c*). After the forming process is completed, the backside plate 61 and back folding plates 62 retracted from the bookbinding path 3. When the sheet bundle is conveyed downstream by the gripping conveyance means 58 in this state, the folding rollers 63 press the sheet bundle into the cover sheet (as shown in FIG. 8(*d*)). This folds the cover sheet over the sheet bundle (the inner sheets) to form the booklet.

Cutting means 65 are disposed in the cutting process position G positioned downstream of the folding rollers 63. The cutting means 65 is composed of a turntable unit 65*a* that changes the orientation of the sheet bundle from top to bottom; an edge pressing unit 65*b* that presses and supports the edges of the sheet bundle to be cut; and a cutting blade unit 65*c*. The turn table unit 65*a* is configured to revolve while nipping the sheet bundle fed from the folding rollers 63. At the same time, the sheet bundle is conveyed and set at the cutting process position G. The edge pressing unit 65*b* is composed of movable pressing members that move at right angles to the bookbinding path 3 to pressing support the sheet bundle edges to be cut. The cutting blade unit 65*c* configured to pressing support the sheet bundle is composed of a flat-blade shaped cutting blade, a blade-edge bearing member that opposes the cutting blade to sandwich the sheet bundle, and a cutter motor that drives the cutting blade.

The cutting means 65 cuts a position amount around the edges excluding the backside of the sheet bundle formed into a booklet in the bookbinding process. Conveyance out rollers 66 and a storage stacker 67 are disposed downstream of the cutting process position G. The storage stacker 67 stores the sheet bundles in an inverted state as shown in the drawing.

What is claimed is:

1. A paper feeder for feeding sheets comprising:

tray means for stacking sheets in a stack on a support surface of a tray, wherein the stack comprises sheets having notched openings in at least one location or sheets free of notched openings;

pickup means for separating a single sheet from the stack of sheets on the sheet support surface of the tray means and for conveying the sheet in a sheet conveyance direction;

sheet conveyance means for conveying the single sheet separated by the pickup means to a predetermined processing position;

projecting guide means disposed on the tray means so as to be movable between a retracted position at least level with the support surface, and a projecting position projecting above the support surface and entering into the notched openings of the sheets when the sheets having the notched openings are disposed on the support surface, said projecting guide means being positioned in the retracted position when the sheets without openings are disposed on the support surface; and wherein the projecting guide means comprises an oblique surface, the oblique surface guiding an upstream side edge, with respect to the sheet conveyance direction, of the notched opening to prevent the fed sheet from being caught by a downstream side edge of the notched opening of a lower sheet when the projecting guide means is in the projecting position.

2. The paper feeder according to claim 1, wherein the projecting guide means comprises an engaging portion for engaging the uppermost sheet to move the oblique surface gradually to the uppermost sheet side according to a reduction of sheets stacked on the sheet support surface of the tray means.

3. The paper feeder according to claim 1, further comprising:

side aligning means provided on the tray means that move in a direction perpendicular to the sheet conveyance direction, the projecting guide means being interlocked to the side aligning means to move to a position perpendicular to the sheet conveyance direction.

4. The paper feeder according to claim 1, wherein the tray means is detachably connected to the apparatus frame.

5. The paper feeder according to claim 1, wherein the retracted position has a position retracted to a level lower than the level of the support surface.

6. The paper feeder according to claim 1, wherein the tray means comprises side aligning means that move in a direction perpendicular to the sheet conveyance direction to align side edges of the sheets on the sheet support surface, the projecting guide means are mounted on the side aligning means.

7. The paper feeder according to claim 1, wherein the oblique surface of the projecting guide means guides an upstream side edge of the opening of the uppermost sheet stacked on the support surface of the tray means so that the upstream side edge of the opening of the uppermost sheet in the sheet conveyance direction does not touch the downstream side edge of the lower sheet opening in the direction of conveyance.

8. The paper feeder according to claim 1, wherein the projecting guide means engages an uppermost sheet of the sheet support surface of the tray means on one side in the sheet conveyance direction; and the projecting guide means has a pivot point for moving one edge following reduction of an amount of sheets stacked in the stack.

9. The paper feeder according to claim 1, wherein the projecting guide means has the oblique surface that separates an uppermost sheet from a lower sheet by touching an upstream side edge of the opening of the sheets stacked on the tray, in the direction of sheet conveyance, the oblique surface comprising a separation member having a high coefficient of friction.

10. The paper feeder according to claim 1, wherein the tray means is configured to selectively stack a first sheet including a narrow, longitudinal opening in the direction of sheet conveyance, and a second sheet including a narrow, horizontal opening in the direction of perpendicular to sheet conveyance; and the projecting guide means are positioned on the sheet support surface of the tray means appropriate for the longitudinal notched opening of the first sheet, and on the sheet support surface of the tray means appropriate for the horizontal notched opening of the second sheet.

11. The paper feeder according to claim 1, wherein the projecting guide means comprises a plurality of pivotal projecting guides wherein each pivotal projection guide is pivotally supported on the tray means and pivotable relative to the tray means between the retracted position and the projected position.

12. The paper feeder according to claim 1, wherein the projecting guide means comprises a plurality of pivotal projecting guides, wherein the support surface comprises a trailing edge support surface and a leading edge support surface which respectively support trailing and leading edges of the sheets stacked on the support surface of the tray means, and wherein a first of the plurality of pivotal projecting guides is disposed on the trailing edge support and a second of the plurality of pivotal projecting guides is disposed on a leading edge support surface in a position essentially aligned with the first of the pivotal projecting guides with respect to the sheet conveyance direction.

13. The paper feeder according to claim 12, wherein the second of the plurality of pivotal projecting guides includes a flexible film member, the film member extending further than the leading edge of the second of the plurality of pivotal projecting guides, the film member bending so that it does not inhibit passage of sheets therepast even when there is a low number of sheets having notched openings stacked on the support surface of the tray.

14. The paper feeder according to claim 12, wherein the projecting guide means further comprises a third pivotal projecting guide which is disposed on the trailing edge support surface, the first and third pivotal projecting guides having a separation member having a high coefficient of friction disposed on oblique surfaces thereof.

* * * * *